US008517800B2

(12) United States Patent
Li et al.

(10) Patent No.: US 8,517,800 B2
(45) Date of Patent: Aug. 27, 2013

(54) POLISHING PAD AND FABRICATING METHOD THEREOF

(75) Inventors: Shiuan-Tzung Li, Hualien County (TW); Chao-Chin Wang, Taichung (TW); Hui-Che Chang, Taichung (TW)

(73) Assignee: IV Technologies Co., Ltd., Taichung (TW)

( * ) Notice: Subject to any disclaimer, the term of this patent is extended or adjusted under 35 U.S.C. 154(b) by 1338 days.

(21) Appl. No.: 12/259,784

(22) Filed: Oct. 28, 2008

(65) Prior Publication Data

US 2009/0181608 A1 Jul. 16, 2009

(30) Foreign Application Priority Data

Jan. 15, 2008 (TW) ..... 97101474 A

(51) Int. Cl.
*B24B 1/00* (2006.01)

(52) U.S. Cl.
USPC ..... 451/56; 451/72; 451/57; 451/443

(58) Field of Classification Search
USPC ..... 451/56, 57, 526, 443, 921, 72; 409/131–132, 293, 301, 297, 139–140; 29/557–558
See application file for complete search history.

(56) References Cited

U.S. PATENT DOCUMENTS 2,059,583 A * 11/1936 Jackson et al. ..... 451/529
4,733,995 A * 3/1988 Aebi ..... 407/34
4,755,337 A 7/1988 Takahashi et al.
5,081,051 A * 1/1992 Mattingly et al. ..... 451/56
5,177,908 A * 1/1993 Tuttle ..... 451/41
5,216,843 A * 6/1993 Breivogel et al. ..... 451/285
5,395,490 A 3/1995 Hoff et al.
5,547,417 A * 8/1996 Breivogel et al. ..... 451/58
5,554,064 A * 9/1996 Breivogel et al. ..... 451/41
5,611,943 A * 3/1997 Cadien et al. ..... 216/88
5,626,509 A * 5/1997 Hayashi ..... 451/285
5,779,521 A * 7/1998 Muroyama et al. ..... 451/56
5,851,138 A * 12/1998 Hempel, Jr. ..... 451/56
5,885,147 A * 3/1999 Kreager et al. ..... 451/443
5,962,131 A 10/1999 Schwind et al.
6,004,193 A * 12/1999 Nagahara et al. ..... 451/285
6,126,532 A * 10/2000 Sevilla et al. ..... 451/526
6,135,863 A * 10/2000 Zhang et al. ..... 451/56
6,139,404 A * 10/2000 Yau ..... 451/56
6,207,772 B1 3/2001 Hatsuda et al.
6,273,798 B1 * 8/2001 Berman ..... 451/72
6,347,981 B1 * 2/2002 Holzapfel ..... 451/56
6,371,836 B1 * 4/2002 Brown et al. ..... 451/56
6,435,952 B1 * 8/2002 Boyd et al. ..... 451/72
6,641,471 B1 11/2003 Pinheiro et al.
6,679,769 B2 1/2004 Pinheiro et al.

(Continued)

OTHER PUBLICATIONS

Chinese Office Action dated Oct. 26, 2011 with English Translation.

(Continued)

*Primary Examiner* — George Nguyen
(74) *Attorney, Agent, or Firm* — Ditthavong Mori & Steiner P.C.

(57) ABSTRACT

A method of fabricating a polishing pad for polishing an article is described. The method includes providing a semi-finished polishing pad and then forming a moving track on the surface of the semi-finished polishing pad. The moving track substantially coincides with a polishing track of the article on the polishing pad.

33 Claims, 3 Drawing Sheets

(56) References Cited

U.S. PATENT DOCUMENTS

| | | | | |
|---|---|---|---|---|
| 6,743,080 | B2 * | 6/2004 | Truong | 451/56 |
| 6,821,190 | B1 * | 11/2004 | Towery | 451/41 |
| 6,837,781 | B2 * | 1/2005 | Hishiki | 451/527 |
| 6,932,548 | B2 * | 8/2005 | Obrachta | 409/234 |
| 6,945,857 | B1 * | 9/2005 | Doan et al. | 451/56 |
| 7,070,484 | B2 | 7/2006 | Wu et al. | |
| 7,094,134 | B2 | 8/2006 | Lujan | |
| 7,163,435 | B2 * | 1/2007 | Lim et al. | 451/5 |
| 7,261,625 | B2 * | 8/2007 | Hishiki | 451/526 |
| 7,267,608 | B2 * | 9/2007 | Kramer | 451/444 |
| 7,300,340 | B1 * | 11/2007 | Elmufdi et al. | 451/527 |
| 2004/0192172 | A1 * | 9/2004 | Towery et al. | 451/41 |
| 2004/0203325 | A1 * | 10/2004 | Donohue | 451/56 |
| 2004/0224617 | A1 * | 11/2004 | Towery | 451/56 |
| 2004/0224622 | A1 | 11/2004 | Sakurai et al. | |
| 2006/0128279 | A1 * | 6/2006 | Taylor | 451/56 |
| 2006/0141910 | A1 * | 6/2006 | Kramer | 451/56 |
| 2006/0270237 | A1 * | 11/2006 | Chuang et al. | 438/692 |
| 2008/0153398 | A1 * | 6/2008 | Sung | 451/56 |

OTHER PUBLICATIONS

Article titled "Solvent Effects on Chain Orientation and Interchain Π-Interaction in Conjugated Polymer Thin Films: Direct Measurements of the Air and Substrate Interfaces by Near-Edge X-ray Absorption Spectroscopy", authored by Ho, et al., adopted from Advanced Materials, 2007, pp. 215-221.

Article titled "Molecular orientation in polymers from near-field optical polarization measurements", authored by Williamson, et al., adopted from J. Vac. Sci. Technol. B 14(2), Mar./Apr. 1996, pp. 809-811.

Article titled "An instrument for online measurement of structural orientation in translucent polymer sheets", authored by Palanisamy, et al., adopted from Bull. Mater. Sci., vol. 23, No. 1, Feb. 2000, pp. 23-26.

* cited by examiner

POLISHING PAD AND FABRICATING METHOD THEREOF

CROSS-REFERENCE TO RELATED APPLICATION

This application claims the priority benefit of Taiwan application serial no. 97101474, filed on Jan. 15, 2008. The entirety of the above-mentioned patent application is hereby incorporated by reference herein and made a part of specification.

BACKGROUND OF THE INVENTION

1. Field of the Invention

The present invention generally relates to a polishing pad and a fabricating method thereof, in particular, to a polishing pad capable of shortening pre-conditioning time and a fabricating method thereof.

2. Description of Related Art

With the progress of the industry, a planarization process is usually adopted as a process for manufacturing various devices. A polishing process is usually used in the planarization process in the industry. Generally speaking, in the polishing process, a pressure is applied to press an article on a polishing pad, and a relative movement is produced between the article and a surface of the polishing pad. Through the friction generated by the relative movement, a part of the surface of the article is removed, such that the surface gradually becomes planarized.

Generally, after a new polishing pad affixed on a polishing machine and before being used in the planarization process of the article, a surface treatment procedure by a surface conditioner is usually performed on the surface of the polishing pad. Then, a dummy polishing procedure similar to the real polishing is performed on the surface of the polishing pad through polishing a dummy article. The above-mentioned pre-conditioning procedures enable the surface of the polishing pad to achieve a stable state. Usually, the pre-conditioning time takes approximately 20 to 60 minutes. Therefore, the polishing machine may be occupied for 20 to 60 minutes, and cannot be used for performing the real product polishing. For the user, the time is inevitably wasted, which influences the production efficiency.

Therefore, a polishing pad capable of shortening the pre-conditioning time is required.

SUMMARY OF THE INVENTION

Accordingly, the present invention is directed to a polishing pad and a fabricating method thereof, capable of shortening the pre-conditioning time before using.

The present invention provides a method of fabricating the polishing pad for polishing an article. The method includes providing a semi-finished polishing pad, and then forming a moving track on a surface of the semi-finished polishing pad. The moving track substantially coincides with a polishing track of the article on the polishing pad.

The present invention further provides a method of fabricating the polishing pad for polishing an article. The method includes providing a semi-finished polishing pad, and then forming a deformation orientation on the surface of the semi-finished polishing pad. The deformation orientation substantially coincides with a polishing orientation of the article on the polishing pad.

The present invention further provides a polishing pad for polishing an article. The polishing pad includes a polishing layer and a moving track on a surface thereof. The moving track substantially coincides with the polishing tack of the article on the polishing pad.

The present invention further provides a polishing pad. The polishing pad includes a polishing layer and a deformation orientation on a surface thereof. A collection of the deformation orientation is nonparallelly distributed.

In the present invention, during the process of fabricating the polishing pad, the special moving track or deformation orientation is formed on the surface of the semi-finished polishing pad, and the moving track or the deformation orientation substantially coincides with the polishing track of the article on the polishing pad. Therefore, the time for pre-conditioning the polishing pad before being used in the planarization process can be shortened, thereby improving the production efficiency.

In order to the make aforementioned and other objects, features and advantages of the present invention comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
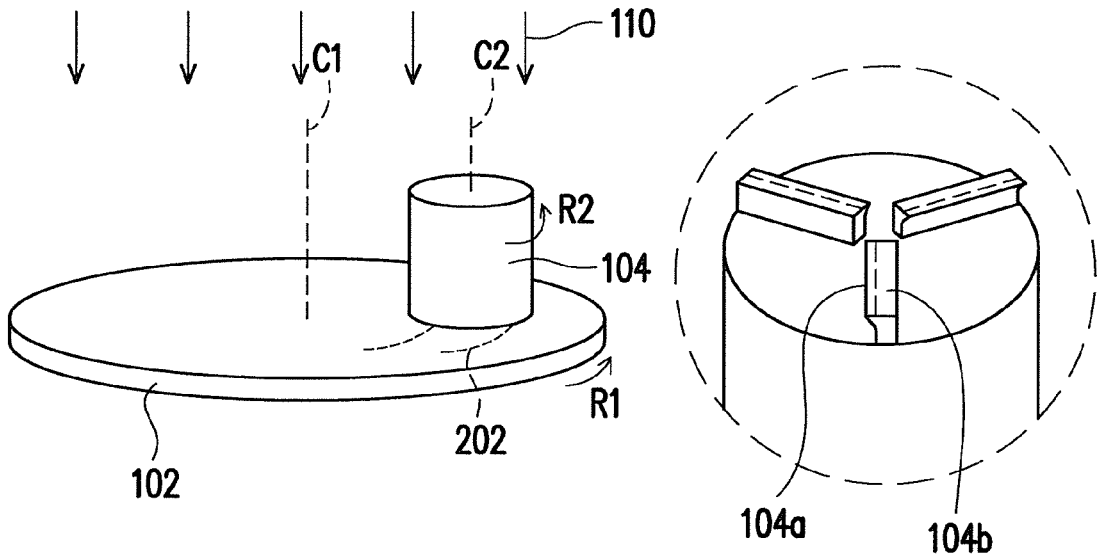
FIG. 1 is a schematic view of a method of fabricating the polishing pad according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

In order to shorten the pre-conditioning time of the polishing pad before being used in the planarization process, in the processes of fabricating the polishing pad in the present invention, a special deformation orientation or moving track is formed on the surface of the polishing pad, and the deformation orientation or the moving track substantially coincides with the polishing track of an article on the polishing pad during polishing. The method of fabricating the polishing pad and the polishing pad formed by the method are illustrated in the following embodiments, which are not intended to limit the scope of the present invention, but to make those skilled in the art understand the present invention.

FIG. 1 is a schematic view of a method of fabricating the polishing pad according to an embodiment of the present invention. Referring to FIG. 1, first, a semi-finished polishing pad 102 is provided. The semi-finished polishing pad 102 is, for example, formed by a molding or a rolling-type continuous process, and is, for example, constituted of a polymer material. The polymer material may be polyester, polyether, polyurethane, polycarbonate, polyacrylate, polybutadiene, epoxy, unsaturated polyester, or other polymer material synthesized by suitable thermosetting resin or thermoplastic resin, etc. In another embodiment, in addition to the polymer material, the semi-finished polishing pad 102 may further include a conductive material, abrasive particles, microsphere, or dissolvable additives in the polymer material.

After the semi-finished polishing pad 102 is provided, a moving track 202 is formed on the surface of the semi-finished polishing pad 102. In an embodiment, the moving track 202 may be formed during the process of performing a leveling step on the semi-finished polishing pad 102. In detail, usually after the semi-finished polishing pad 102 is finished, a leveling step is performed to remove a skin layer of the semi-finished polishing pad 102. In this embodiment, during the leveling step, the special moving track 202 is formed on the surface of the semi-finished polishing pad 102.

In an embodiment, as shown in FIG. 1, the leveling step is, for example, performed by a rotatable plane cutting tool 104. The size of the rotatable plane cutting tool 104 is, for example, approximately the same as the size of the article to be polished. The rotatable plane cutting tool 104 includes at least a cutting edge portion 104*a* and at least a planar bottom portion 104*b*. On the right side of FIG. 1, an enlarged schematic view of the rotatable plane cutting tool 104 is shown vertically inverted by 180 degrees. The lengths of the cutting edge portion 104*a* and the planar bottom portion 104*b* are respectively approximately close to the radius of the rotatable plane cutting tool 104. The cutting edge portion 104*a* and the planar bottom portion 104*b* are disposed on the bottom of the rotatable plane cutting tool 104 and substantially extend from the center to the periphery. When the leveling step is performed by using the rotatable plane cutting tool 104, a relative movement is produced between the rotatable plane cutting tool 104 and the semi-finished polishing pad 102. That is, the rotatable plane cutting tool 104 orbits around an axis center C1 in an R1 direction, and at the same time, the rotatable plane cutting tool 104 rotates around an axis center C2 in an R2 direction. Therefore, when the skin layer of the semi-finished polishing pad 102 is removed by the cutting edge portion 104 of the rotatable plane cutting tool 104, the planar bottom portion 104*b* contacts the surface of the semi-finished polishing pad 102, so as to cause a plane friction to produce a shear force, such that the special moving track 202 is formed on the surface of the semi-finished polishing pad 102.

In addition, when the leveling step is performed by using the rotatable plane cutting tool 104, a surface treatment step 110 is optionally performed on the surface of the semi-finished polishing pad 102. The surface treatment step 110 is, for example, applying light, heat, microwave, ultrasonic wave, electromagnetic wave, plasma, electric field, magnetic field, or fluid, etc.

It should be particularly noted that the moving path of the rotatable plane cutting tool 104 on the semi-finished polishing pad 102 substantially coincides with the moving path of the article on the polishing pad during subsequent polishing. In other words, the movement of the rotatable plane cutting tool 104 simulates the moving path of the article on the polishing pad during polishing. Therefore, the moving track of the rotatable plane cutting tool 104 formed on the semi-finished polishing pad 102 substantially coincides with the polishing track of the article on the polishing pad during subsequent polishing.

It should be illustrated in detail that when the polishing of the article is performed on the polishing pad, the polishing pad may rotate and the article may also spin, so the movement of the article on the polishing pad has an orbital track and a spinning track. Similarly, the movement of the rotatable plane cutting tool 104 simulates the moving path of the article on the polishing pad during polishing, so the moving track 202 of the rotatable plane cutting tool 104 formed on the semi-finished polishing pad 102 has an orbital track relative to an orbital center (C1), and has a spinning track relative to a spinning center (C2).

Figure 2:
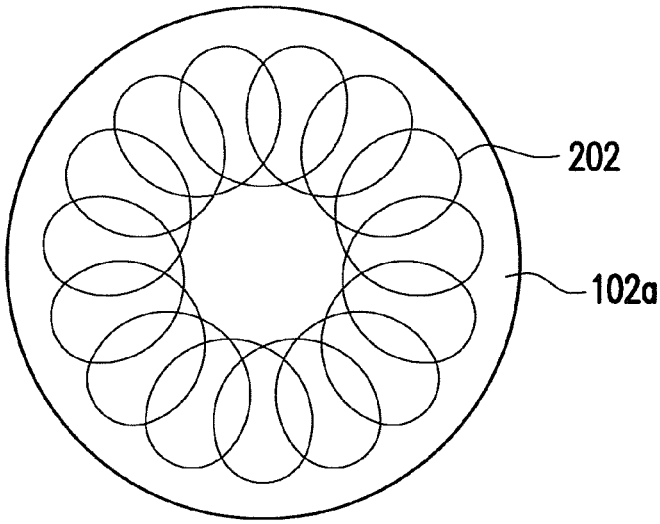
FIG. 2 is a schematic view of forming a special moving track or deformation orientation on the polishing pad according to an embodiment of the present invention.

FIG. 2 shows a polishing pad formed by the method as shown in FIG. 1. In FIG. 2, the polishing layer 102*a* has the moving track 202, and the moving track 202 is formed by the rotatable plane cutting tool 104 as shown in FIG. 1. Therefore, the formed moving track 202 is nonparallelly distributed. Particularly, the moving track 202 has an orbital track relative to the center (i.e. the axis center C1 of FIG. 1) of the polishing pad, and has a spinning track relative to the axis center C2 of the rotatable plane cutting tool 104 of FIG. 1, so as collectively to form a spiral track. In detail, the moving track 202 may be an annular spiral track. The annular spiral track is not limited to an enclosed track as shown in FIG. 2, and the annular spiral track may also be a non-enclosed track, for example, a non-enclosed track swirling from the center of the polishing pad to the periphery of the polishing pad. Alternatively, the annular spiral track is not limited to the circular ring shape as shown in FIG. 2. For example, an additional relative movement is produced between the rotatable plane cutting tool 104 and the semi-finished polishing pad 102. When orbiting around the axis center C1 in the R1 direction and spinning around the axis center C2 in the R2 direction, the rotatable plane cutting tool 104 further swings to-and-fro relative to the radius direction of the polishing pad, so as to form a wave-shaped annular spiral track. It should be particularly noted that for the convenience of illustration, FIG. 2 only shows the simplified track composed of a single spinning radius. Those skilled in the art should know that the track formed through the above procedures includes the track composed of different spinning radius. That is to say, the annular spiral track in FIG. 2 spreads all over the circular ring region.

The surface of the semi-finished polishing pad 102 is contacted during the leveling step, so as to cause the plane friction to produce a shear force, such that a deformation orientation is formed on the surface of the semi-finished polishing pad 102, the deformation orientation substantially coincides with a polishing orientation of the article on the polishing pad during the subsequent article polishing process, and the collection of the deformation orientation substantially coincides with the polishing track on the polishing pad during the subsequent article polishing process. In other words, the moving track 202 is the collection of the deformation orientation formed on the surface of the semi-finished polishing pad 102. The deformation orientation is, for example, the microscopic surface morphology orientation, which may be analyzed by SEM. The deformation orientation may also be smaller than microscopic feature, for example, the molecular orientation of the polymer material of the surface, which may be analyzed by atomic force microscopy or near-field optical microscopy. The surface treatment step 110 as shown in FIG. 1 may assist the formation of the deformation orientation.

Figure 3:
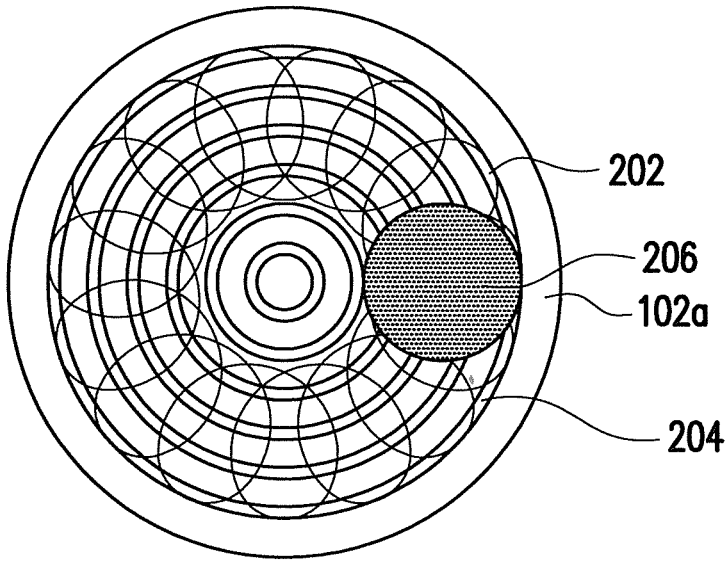
FIG. 3 is a schematic view of forming grooves on the polishing pad as shown in FIG. 2.

After the moving track 202 as shown in FIG. 2 is formed, as shown in FIG. 3, grooves 204 may be further formed on the polishing layer 102*a*. In this embodiment, the grooves 204 are distributed, for example, in the shape of concentric circles, but the present invention is not limited to this. Actually, the grooves 204 may also be distributed in a shape of radial, dotted, grid, etc.

In another embodiment, the grooves 204 may also be formed on the semi-finished polishing pad 102 before the polishing track 202 is formed. That is to say, after the grooves are formed on the semi-finished polishing pad, the leveling step is performed on the semi-finished polishing pad 102 by using the rotatable plane cutting tool 104 as shown in FIG. 1, and at the same time, the moving track 202 is formed on the surface of the semi-finished polishing pad.

The subsequent procedure of finishing the polishing pad may still include forming a affixing layer on a back side of the polishing layer 102*a* so as to affix the polishing pad on the polishing table. Further, the procedure may further include forming a soft supporting layer between the polishing layer and the affixing layer, so as to finish the polishing pad.

Then, the polishing pad may be used to polish the article 206 in the planarization process. The article 206 is, for example, a wafer, a substrate, or other article in need of the planarization. Particularly, when the polishing of the article is performed on the pad, the polishing track may substantially coincide with the moving track 202. In an embodiment, the polishing pad may reduce approximately 20% or more percentage of the pre-conditioning time, sometimes even reducing 50% of the pre-conditioning time. The polishing pad of the present invention may be applied in the polishing process for fabricating devices of the semiconductor, integrated circuit, micro-electro-mechanical system, energy conversion, communication, optics, storage disk, and display industries, etc. The article 206 for fabricating the devices may include a semiconductor wafer, III V group wafer, storage device carrier, ceramic substrate, polymer substrate, and glass substrate, etc, but is not intended to limit the scope of the present invention. In addition, a slurry or solution may optionally be used in the polishing process, and thus the polishing process becomes a chemical mechanical polishing (CMP) process.

Figure 4:
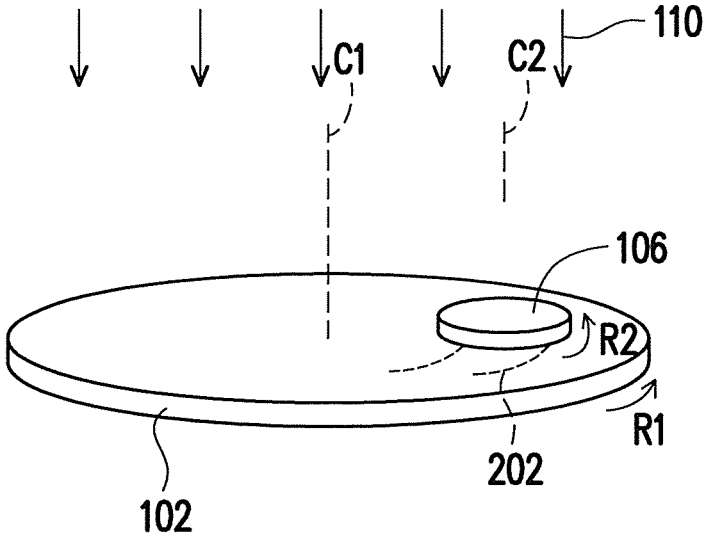
FIG. 4 is a schematic view of a method of fabricating the polishing pad according to another embodiment of the present invention.

In the above embodiment, the moving track 202 is formed on the semi-finished polishing pad 102 by the rotatable plane cutting tool 104. In another embodiments, the moving track 202 may also be formed in other manners. As shown in FIG. 4, a dummy polishing is performed on the surface of the semi-finished polishing pad 102 by using a dummy article 106, and the dummy polishing causes the plane friction to produce a shear force, so as to form the moving track 202 of the similar features as shown in FIG. 2 and its corresponding illustration on the surface of the semi-finished polishing pad 102. The dummy article 106 is, for example, a dummy wafer, a dummy substrate, etc. The size of the dummy article 106 is, for example, approximately the same as the size of the article to be polished.

The surface of the semi-finished polishing pad 102 is contacted by using the step of the dummy polishing, so as to cause the plane friction to produce a shear force. Thus, a deformation orientation is formed on the surface of the semi-finished polishing pad 102, and the collection of the deformation orientation substantially coincides with the polishing track of the article on the polishing pad during subsequent polishing. In other words, the moving track 202 is the collection of the deformation orientation formed on the surface of the semi-finished polishing pad 102.

In an embodiment, before the moving track 202 formed on the surface of the semi-finished polishing pad 102 by using the dummy article 106, the leveling step is performed on the semi-finished polishing pad 102, so as to remove the skin layer of the semi-finished polishing pad 102. The leveling step may be performed by using the rotatable plane cutting tool 104 as shown in FIG. 1. In other words, the leveling step may be first performed by using the rotatable plane cutting tool 104, such that after the skin layer of the semi-finished polishing pad 102 is removed and the moving track 202 is formed. Then, the dummy polishing is further performed on the semi-finished polishing pad 102 by using the dummy article 106, so as to form the moving track 202 repeatedly on the surface of the semi-finished polishing pad 102.

Similarly, when forming the moving track 202 on the surface of the semi-finished polishing pad 102 by the dummy article 106, a surface treatment step 110 may also be performed on the surface of the semi-finished polishing pad 102. The surface treatment step 110 is, for example, applying light, heat, microwave, ultrasonic wave, electromagnetic wave, plasma, electric field, magnetic field, or fluid, etc. The surface treatment step 110 may assist the formation of the deformation orientation. In addition, after the moving track 202 is formed, the grooves 204 (as shown in FIG. 3) may be further formed on the polishing layer 102*a*. In this embodiment, the grooves 204 are, for example, distributed in the shape of the concentric circles, but the present invention is not limited to this. Actually, the grooves 204 may also be distributed in a shape of radial, dotted, grid, etc. Similarly, the grooves 204 may also be formed on the semi-finished polishing pad before the polishing track 202 is formed. That is, after the grooves are formed on the semi-finished polishing pad, the moving track 202 is formed on the surface of the semi-finished polishing pad 102 using the dummy article 106 as shown in FIG. 4.

Figure 5:
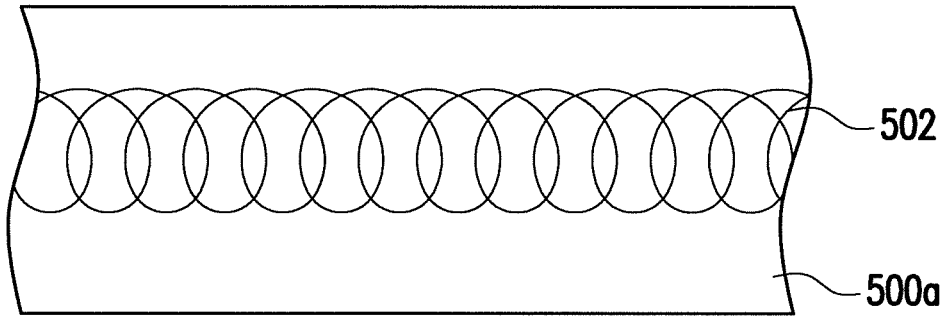
FIG. 5 is a schematic view of forming a special moving track or deformation orientation on the belt-shape polishing pad according to another embodiment of the present invention.
Figure 6:
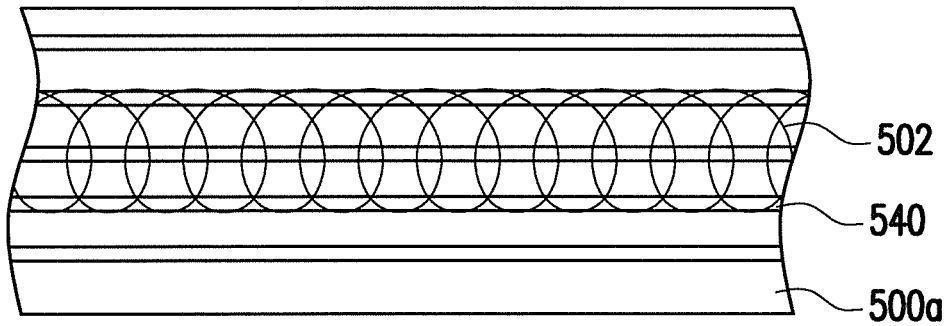
FIG. 6 is a schematic view of forming grooves on the belt-shape polishing pad as shown in FIG. 5.

In the embodiments as shown in FIGS. 1 to 4, the round-shape polishing pad is set as an example for illustration, and actually the method of the present invention may be applied to the belt-shape polishing pad. As shown in FIG. 5, a moving track 502, for example, belt-shape spiral track may be formed on a polishing layer 500*a* by using the rotatable plane cutting tool or the dummy article, and the moving track 502 substantially coincides with the polishing track of the article on the polishing pad during subsequent polishing. Similarly, when the moving track 502 is formed on the polishing layer 500*a* by using the rotatable plane cutting tool or the dummy article, a surface treatment step, for example, applying light, heat, microwave, ultrasonic wave, electromagnetic wave, plasma, electric field, magnetic field, or fluid etc may also be performed, so as to assist the forming of the deformation orientation. As shown in FIG. 6, before or after the moving track 502 is formed, the grooves 504 may be further formed on the polishing layer 500*a*.

According to the polishing pad and the fabricating method thereof provided by the embodiments of the present invention, the special moving track or deformation orientation is formed on the polishing layer through the shear force. In the present invention, the shear force is not limited to be produced by the rotatable plane cutting tool or the dummy article polishing. The moving track or the deformation orientation may be formed by the shear force produced in other manners, i.e. a contacting manner or a non-contacting manner. The moving track or the collection of the deformation orientation substantially coincides with the polishing track of the article on the polishing pad. Because the moving track or the deformation orientation is pre-existed on the surface of the polishing pad, the time for pre-conditioning the polishing pad before being used in the planarization process can be shortened, thereby improving the production efficiency.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method of fabricating a polishing pad for polishing an article, comprising:

providing a semi-finished polishing pad;

forming a moving track by performing a leveling step on a surface of the semi-finished polishing pad;

and performing a surface treatment step on the surface of the semi-finished polishing pad, wherein the moving track substantially coincides with a polishing track of the article on the polishing pad.

2. The method of fabricating a polishing pad according to claim 1, wherein the leveling step comprises using a rotatable plane cutting tool.

3. The method of fabricating a polishing pad according to claim 2, wherein a size of the rotatable plane cutting tool is approximately the same as a size of the article.

4. The method of fabricating a polishing pad according to claim 2, wherein the rotatable plane cutting tool comprises at least a cutting edge portion and at least a planar bottom portion.

5. The method of fabricating a polishing pad according to claim 1, wherein the step of forming a moving track comprises performing a dummy polishing on the surface of the semi-finished polishing pad.

6. The method of fabricating a polishing pad according to claim 5, wherein the leveling step is performed on the semi-finished polishing pad prior to performing the dummy polishing.

7. The method of fabricating a polishing pad according to claim 1, after the step of forming the moving track, further comprising forming at least a groove on the semi-finished polishing pad.

8. The method of fabricating a polishing pad according to claim 1, before the step of forming the moving track, further comprising forming at least a groove on the semi-finished polishing pad.

9. The method of fabricating a polishing pad according to claim 1, wherein the surface treatment step comprises applying light, heat, microwave, ultrasonic wave, electromagnetic wave, plasma, electric field, magnetic field, or fluid.

10. The method of fabricating a polishing pad according to claim 1, wherein the moving track is nonparallelly distributed.

11. The method of fabricating a polishing pad according to claim 1, wherein the moving track comprises a spinning track relative to a spinning center.

12. The method of fabricating a polishing pad according to claim 1, wherein the moving track comprises an orbital track relative to an orbital center.

13. The method of fabricating a polishing pad according to claim 1, wherein the moving track is a spiral track.

14. The method of fabricating a polishing pad according to claim 13, wherein the spiral track is a belt-shape spiral track or an annular spiral track.

15. The method of fabricating a polishing pad according to claim 1, wherein the step of forming the moving track comprises applying a shear force.

16. The method of fabricating a polishing pad according to claim 15, wherein the shear force is applied in a contacting manner or a non-contacting manner.

17. A method of fabricating a polishing pad, wherein the polishing pad is used to polish an article, comprising:

providing a semi-finished polishing pad;

forming a deformation orientation and a leveling step on a surface of the semi-finished polishing pad;

and performing a surface treatment step on the surface of the semi-finished polishing pad, wherein the deformation orientation substantially coincides with a polishing orientation of the article on the polishing pad.

18. The method of fabricating a polishing pad according to claim 17, wherein the deformation orientation comprises a surface morphology orientation or a molecular orientation.

19. The method of fabricating a polishing pad according to claim 18, wherein the leveling step comprises using a rotatable plane cutting tool.

20. The method of fabricating a polishing pad according to claim 19, wherein a size of the rotatable plane cutting tool is approximately the same as a size of the article.

21. The method of fabricating a polishing pad according to claim 19, wherein the rotatable plane cutting tool comprises at least a cutting edge portion and at least a planar bottom portion.

22. The method of fabricating a polishing pad according to claim 17, wherein the step of forming the deformation orientation comprises performing a dummy polishing on the surface of the semi-finished polishing pad.

23. The method of fabricating a polishing pad according to claim 22, wherein the leveling step is performed on the semi-finished polishing pad prior to performing the dummy polishing.

24. The method of fabricating a polishing pad according to claim 17, wherein after the step of forming the deformation orientation, further comprising forming at least a groove on the semi-finished polishing pad.

25. The method of fabricating a polishing pad according to claim 17, before the step of forming the deformation orientation, further comprising forming at least a groove on the semi-finished polishing pad.

26. The method of fabricating a polishing pad according to claim 17, wherein the surface treatment step comprises applying light, heat, microwave, ultrasonic wave, electromagnetic wave, plasma, electric field, magnetic field, or fluid.

27. The method of fabricating a polishing pad according to claim 17, wherein a collection of the deformation orientation is nonparallelly distributed.

28. The method of fabricating a polishing pad according to claim 17, wherein a collection of the deformation orientation comprises a spinning track relative to a spinning center.

29. The method of fabricating a polishing pad according to claim 17, wherein a collection of the deformation orientation comprises an orbital track relative to an orbital center.

30. The method of fabricating a polishing pad according to claim 17, wherein a collection of the deformation orientation is a spiral track.

31. The method of fabricating a polishing pad according to claim 30, wherein the spiral track is a belt-shape spiral track or an annular spiral track.

32. The method of fabricating a polishing pad according to claim 17, wherein the step of forming the deformation orientation comprises applying a shear force.

33. The method of fabricating a polishing pad according to claim 32, wherein the shear force is applied in a contacting manner or a non-contacting manner.

* * * * *